US007020987B2

(12) United States Patent
Issler

(10) Patent No.: US 7,020,987 B2
(45) Date of Patent: Apr. 4, 2006

(54) METHOD AND APPARATUS FOR A SHOE HAVING IMPROVED SHOE CONSTRUCTION

(75) Inventor: James E. Issler, Greenwich, CT (US)

(73) Assignee: Columbia Insurance Co., Omaha, NE (US)

( * ) Notice: Subject to any disclaimer, the term of this patent is extended or adjusted under 35 U.S.C. 154(b) by 138 days.

(21) Appl. No.: 10/413,823

(22) Filed: Apr. 15, 2003

(65) Prior Publication Data

US 2004/0205980 A1 Oct. 21, 2004

(51) Int. Cl.
*A43B 13/28* (2006.01)
*A43B 9/02* (2006.01)

(52) U.S. Cl. ..... 36/19 R; 36/17 PW; 36/18; 36/12; 12/142 A; 12/142 C; 12/142 D; 12/142 RS

(58) Field of Classification Search ..... 36/17 R, 36/19 R, 18, 17 PW, 25 R, 12; 12/142 A, 12/142 B, 142 C, 142 D, 142 RS
See application file for complete search history.

(56) References Cited

U.S. PATENT DOCUMENTS 2,201,382 A * 5/1940 Vizard ..... 36/17 R
3,736,613 A * 6/1973 Tusa et al. ..... 36/17 R
3,821,827 A 7/1974 Nadler
4,170,802 A 10/1979 Roy
4,369,589 A 1/1983 Summey
4,756,098 A 7/1988 Boggia
4,908,964 A 3/1990 Deem
5,768,801 A * 6/1998 Huff ..... 36/17 R
6,029,301 A * 2/2000 Issler et al. ..... 36/19 R
6,192,605 B1 2/2001 Challant
6,226,895 B1 5/2001 McClelland
6,560,900 B1 * 5/2003 Bray et al. ..... 36/19 R
6,574,886 B1 * 6/2003 Issler ..... 36/17 R
6,601,319 B1 * 8/2003 Clements ..... 36/17 R
6,637,131 B1 * 10/2003 Lee ..... 36/17 R
6,763,610 B1 * 7/2004 Issler ..... 36/19 R
2003/0196349 A1 * 10/2003 Vincentini ..... 36/19 R

* cited by examiner

*Primary Examiner*—Anthony Stashick
(74) *Attorney, Agent, or Firm*—St. Onge Steward Johnston & Reens LLC

(57) ABSTRACT

The invention relates to a method and apparatus for providing a shoe having a sole with a top surface, a fore area, and a rear area. The shoe also includes a lip extending above the top surface and around a periphery of the fore area of the sole and around a periphery of the rear area of the sole. The shoe further includes an upper with a fore area and a rear area and being in contact with the lip. A first stitch is used to connect the fore area of the upper to the lip proximate to the fore area of the sole and a second stitch is used to connect the rear area of the upper to the lip proximate to the rear area of the sole.

7 Claims, 9 Drawing Sheets

METHOD AND APPARATUS FOR A SHOE HAVING IMPROVED SHOE CONSTRUCTION

FIELD OF THE INVENTION

The invention relates to a shoe having an improved shoe construction, resulting in reduced manufacturing costs.

BACKGROUND OF THE INVENTION

A variety of different sole constructions are used by the footwear industry. For the most part, each sole construction has characteristics that make it particularly well-suited for specific applications. For example, some sole constructions are selected for their durability, others for their flexibility and comfort, while still others are selected for their aesthetic appeal.

One type of shoe construction is referred to as a welt construction, which is typically a strip of material such as leather or hard rubber used to secure the sole and the upper together. Welt constructions generally provide durability and aesthetic appeal. FIG. 1 is a cross sectional view of a conventional goodyear welt construction. This construction usually includes a welt 10 that connects an upper 12 and a sole 14. The welt 10 often includes a base portion 16 with an upwardly extending rib 18 located toward the center of the base portion and a downwardly extending rib 19 located at the inner edge of the base portion 16. The sole 14 may include an insole 20, a midsole 22, and an outsole 24. The insole 20 typically includes a downwardly extending rib 18 that is used to connect the insole 20, upper 12 and welt 10.

Welt construction typically involves a number of manufacturing operations or steps. Normally, the upper is wrapped around a last and secured to the insole by stapling, stitching, or other fastening mechanism. This step typically provides the upper with a desired shape and is commonly referred to as lasting. Once lasted, the welt is usually secured to the upper and insole by stitches or staples that extend through downwardly extending rib 19, the bottom periphery of the upper 12, and the insole rib 26. The midsole may be secured to the bottom of the upper/insole assembly. Typically, the midsole is attached to the upper/insole assembly by stitching that extends through the base portion 16 of the welt 10 and the midsole 22. Although this construction is believed to be durable and aesthetically appealing, it is generally a heavy construction and typically does not provide flexibility relative to other shoe constructions. Moreover, due to the number of manufacturing operations specified above, the cost of providing a welt construction shoe may be higher than other shoe constructions.

U.S. Pat. No. 6,226,895 to McClelland ("McClelland") appears to disclose a shoe having a welt that extends around a periphery of the shoe, where the welt secures the upper to the insole and outsole. The shoe seems to show a first stitch extending through the welt, upper, and insole to secure these members together. A second stitch seems to extend through the welt and outsole to secure the welt, upper, and insole to the outsole.

U.S. Pat. No. 6,192,605 to Challant ("Challant") appears to disclose a molded midsole and a molded welt, where both the welt and midsole are molded into a single unit. The resulting shoe is believed to reduce manufacturing costs without sacrificing benefits of a shoe employing a welt.

Both Challant and McClelland do not appear to relate to a shoe construction that secures the upper to a midsole or outsole without a need for a welt. Further, both references seem to disclose an insole as part of the shoe. construction.

Cementing components of a shoe, such as the upper to the midsole or outsole, often involves a number of manufacturing operations. Typically, there is a surface preparation step where the surfaces to be cemented, or glued, are clean of debris and readied, which may also include roughening. Further, there may be an application step where the cement is applied to the surfaces. This step may also involve measuring and evenly distributing the glue over the surface.

Further, there may be a pressing step where the surfaces are pressed together. Pressing is believed to reduce air that may be trapped between the surfaces and enhances adhesion. Pressing may also include aligning the surfaces so that the peripheries of the components are flush with one another.

Additionally, once the components are pressed together, cementing often requires a waiting period for the cement to cure, or dry. Generally, not only does cementing involve some or all of the above mentioned manufacturing operations, it also involves time, particularly the curing time.

It is believed that the number of steps and time involved, especially if user intervention is required, negatively affects cost and efficiency. The cementing process may be further complicated if the surfaces to be glued are uneven or difficult to reach.

U.S. Pat. Nos. 4,369,589 to Summey ("Summey") and 3,821,827 to Nadler ("Nadler") appear to disclose a shoe having cement or glue to secure the upper to the midsole or outsole. Summey seems to disclose the pressing and aligning operations as well as user intervention described above. Summey also seems to disclose an insole as a part of the shoe.

What is desired, therefore, is a shoe that may be constructed in a more efficient manner, including reduced manufacturing costs and less manufacturing operations. What is also desired is a shoe that is more flexible to enhance comfort. A further desire is to provide a shoe that is lighter to enhance wearability.

SUMMARY OF THE INVENTION

The invention and its particular features and advantages will become more apparent from the following detailed description considered with reference to the accompanying drawings.

It is an object of the invention to provide a shoe having a construction that employs less manufacturing operations and having reduced costs.

Another desire is to provide a shoe that has improved flexibility and less weight, thereby enhancing comfort.

These and other objects of the invention are obtained by a shoe having a sole with a top surface, a fore area, and a rear area. The shoe also includes a lip extending above the top surface and around a periphery of the fore area of the sole and around a periphery of the rear area of the sole. The shoe further includes an upper with a fore area and a rear area and being in contact with the lip. A first stitch is used to connect the fore area of the upper to the lip proximate to the fore area of the sole and a second stitch is used to connect the rear area of the upper to the lip proximate to the rear area of the sole.

The invention provides the benefits of a durable and aesthetically appealing shoe construction but without a welt or insole or without cement in the fore and rear areas of the shoe.

In a preferred embodiment, the first stitch and second stitch have a common stitching pattern, which may be an opanka, machine, strobel, or other type of stitching pattern. In other embodiments, any combination of stitching patterns may be used.

In some embodiments, the sole is an outsole. In other embodiments, the sole is a midsole.

In another aspect of the invention, a method for providing the above mentioned shoe includes the steps of providing a sole having a top surface, a fore area, and a rear area and providing an upper having a fore area and a rear area. The method also includes the step of extending a lip above the top surface and around a periphery of the fore area of the sole and around a periphery of the rear area of the sole. Further, the method includes stitching the fore area of the upper to the lip in a location proximate to the fore area of the sole and stitching the rear area of the upper to the lip in a location proximate to the rear area of the sole. The method stitches the upper to the lip without a welt or insole or without cement in the fore and rear areas of the shoe.

In another aspect of the invention, an alternative method is employed for constructing the shoe. The method includes the steps of providing a sock lining, providing an upper having a fore area and a rear area, and lining the upper with a liner. The method further stitches the sock lining to the liner in the fore area of the upper and stitches the sock lining to the liner and upper in the rear of the upper. Method further provides a sole having a top surface, a fore area, and a rear area and extends a lip above the top surface and around a periphery of the fore area of the sole and around a periphery of the rear area of the sole. The method also includes the steps of stitching the fore area of the upper to the lip in a location proximate to the fore area of the sole and stitching the rear area of the upper to the lip in a location proximate to the rear area of the sole.

DETAILED DESCRIPTION OF THE DRAWINGS

Figure 1:
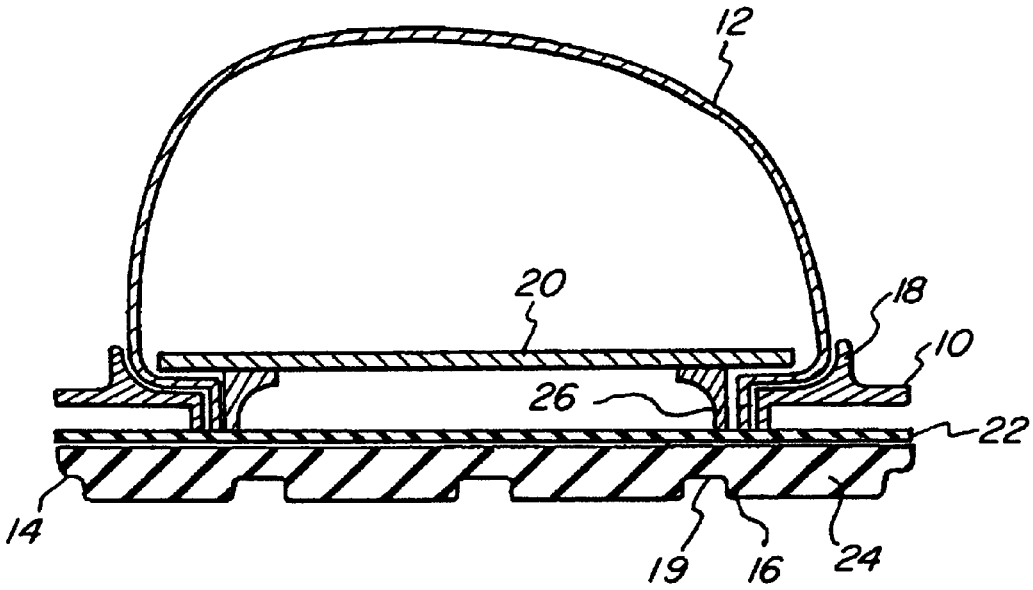
FIG. 1 (PRIOR ART)
FIG. 1 depicts a cross sectional view of a shoe having a goodyear welt in accordance with the prior art.
Figure 2:
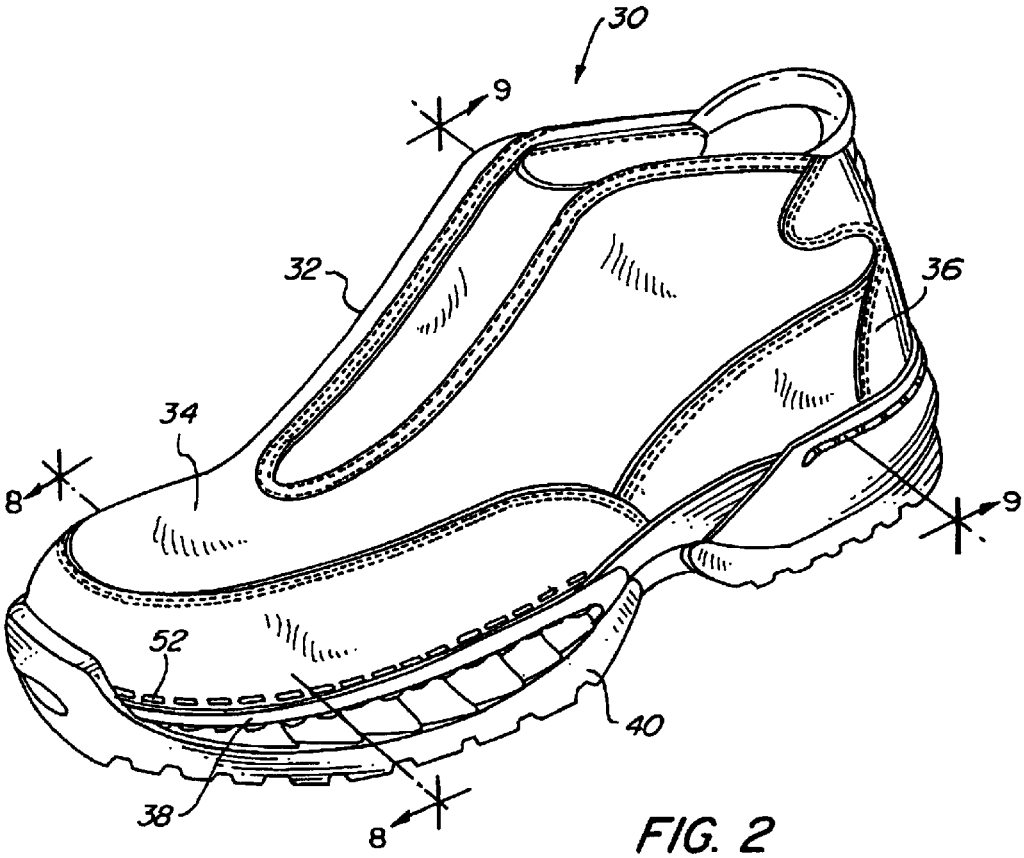
FIG. 2 depicts the shoe in accordance with the invention.

FIG. 2 depicts shoe 30 in accordance with the invention. Shoe 30 includes upper 32, lip 38, sole 40, and stitch 52 for securing upper 32 to lip 34. Upper includes a fore area 34 and rear area 36. Sole 40 includes a top surface 42, fore area 44, and rear area 46.

Figure 4:
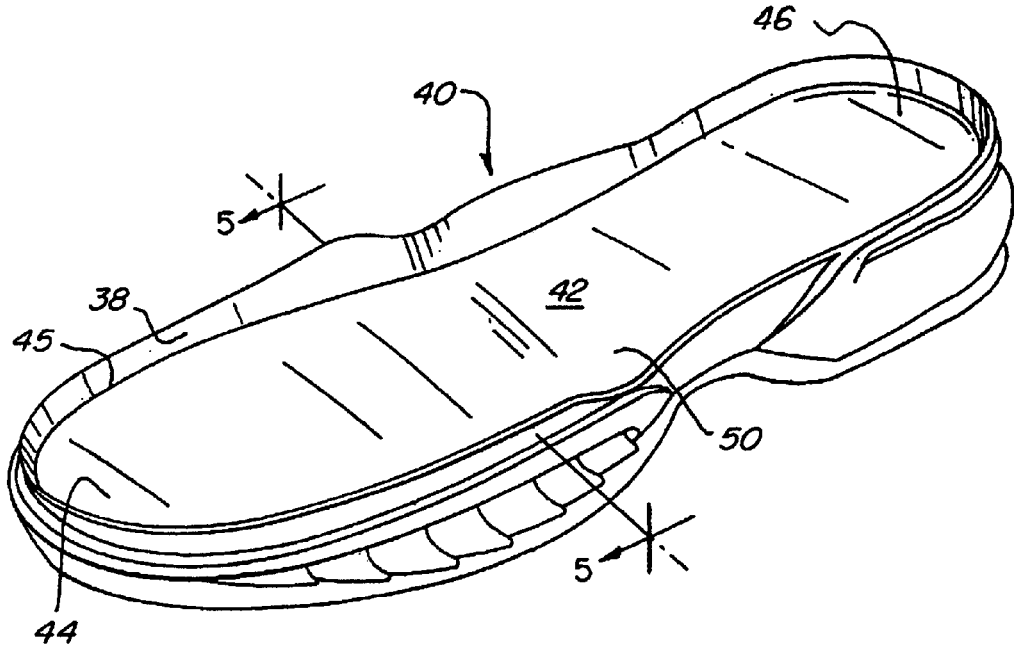
FIG. 4 more particularly depicts the sole of the shoe.
Figure 5:
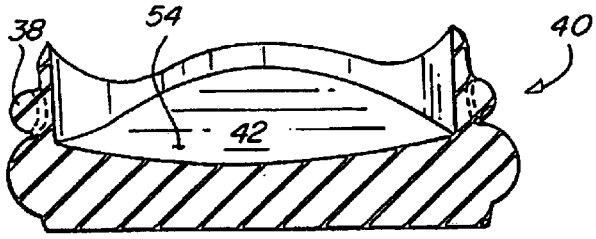
FIG. 5 depicts a cross sectional view of the sole shown in FIG. 4.
Figure 6:
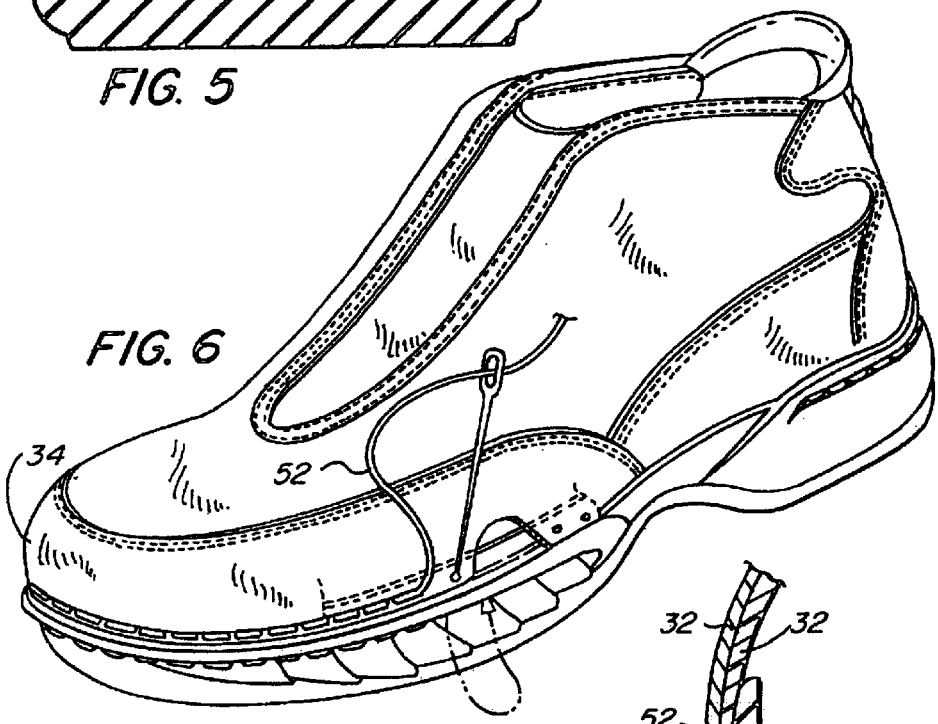
FIG. 6 depicts the securing mechanism for securing the upper to the sole.
Figure 7:
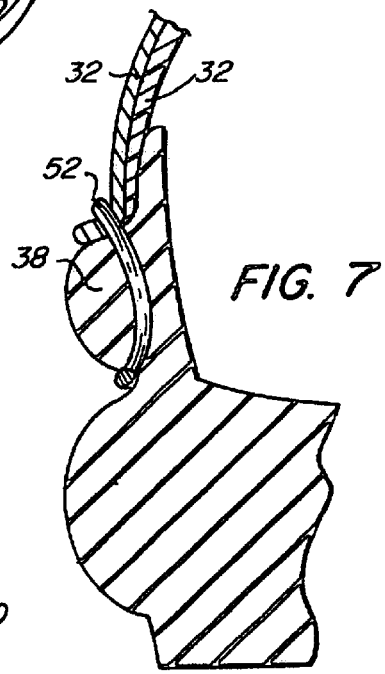
FIG. 7 depicts an exploded view of the securing mechanism for securing the upper to the sole.

More particularly depicted in FIGS. 4, 5, 6, and 7, lip 38 provides a securing mechanism for securing upper 32 to sole 40 without a need for an insole or welt or without cement in the fore and rear areas, as opposed to conventional shoes that typically include at least one of these in their shoe construction. As shown in FIGS. 6 and 7, upper 32 is secured to sole 40 by stitch 52 that is used to sew fore area 34 of upper 32 to lip 38 in a location proximate to fore area 44 of sole 40 and to sew rear area 36 of upper 32 to lip 38 in a location proximate to rear area 46 of sole 40.

As shown in FIGS. 4 and 5, lip 38 extends from top surface 42 of sole 40 in a generally vertical and upward direction. Lip 38 also extends around a periphery 45 of sole 40 in both fore area 46 and rear area 48, where lip 38 and top surface 42 define a cavity 54. Although not required, lip 38 may also extend around a periphery of middle area 50 and upper 32 may be sewn to lip 38 in middle area 50 of sole 40. In other embodiments, middle area 50 is cemented to sole 40. Cementing this area does not compromise the invention's advantages or introduce the disadvantages of a cemented shoe because middle area 50, and the cement that cements middle area 50 to sole 40, is negligibly small given fore and rear areas of shoe 30 are stitched and not cemented.

As shown in FIG. 5, lip 38 is integrally formed with sole 40. However, this is not required for shoe 30 to properly function. In other embodiments, lip 38 is separably attached to sole 40. In these embodiments, lip 38 may be adhered, sewn, or stapled to top surface 42.

Lip 38 provides a securing mechanism for securing upper 32 to sole 40 when stitch 52 is used to sew upper 32 to lip 38 in both fore area 46 and rear area 48 of sole 40. Lip 38 provides the advantages of a welt construction without the disadvantages, as mentioned above in the Background. Lip 38 provides a securing mechanism for stitching upper 32 to sole 40 but lip 38 need not be stitched itself as it is a part of sole 40. Moreover, because of lip 38, shoe 30 has less manufacturing operations than a shoe made with a welt construction. Also, without a welt, shoe 30 has greater flexibility.

In addition, lip 38, together with cavity 54, facilitate alignment with upper 32. This results in a speedier manufacturing process when compared with shoes having soles without any lips or alignment mechanisms, commonly found in shoes where the upper is cemented to the sole.

Figure 9:
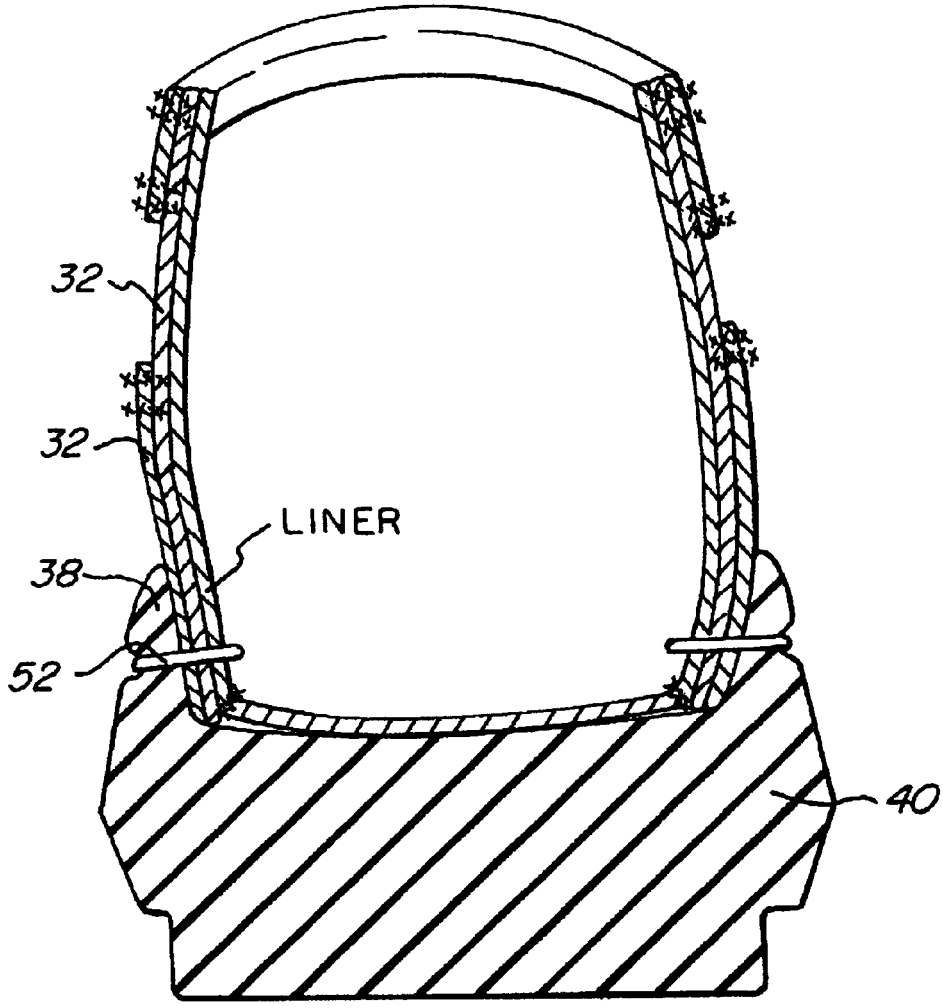
FIG. 9 depicts a cross sectional view of the rear area of the shoe shown in FIG. 2.

As shown in FIGS. 2, 7, and 9, stitch 52 has two sewing patterns for securing upper 32 to lip 38. An opanka stitch is used in the fore area and a machine stitch is used in the rear area. In the embodiment shown, the opanka stitch is a generally vertical stitch and the machine stitch is a generally horizontal stitch. However, the invention should not be limited to these two stitching patterns, as any pattern may be used in either the fore area or rear area of shoe 30. Moreover, it is not necessary to use two different stitching patterns for the invention to properly function. Due to ease in manufacturing, the opanka and machine stitching patterns are employed. Therefore, in other embodiments, the invention envisions using one stitching pattern for both the fore area and the rear area, whether it be opanka, machine, strobel, or other type of stitching pattern.

Figure 3:
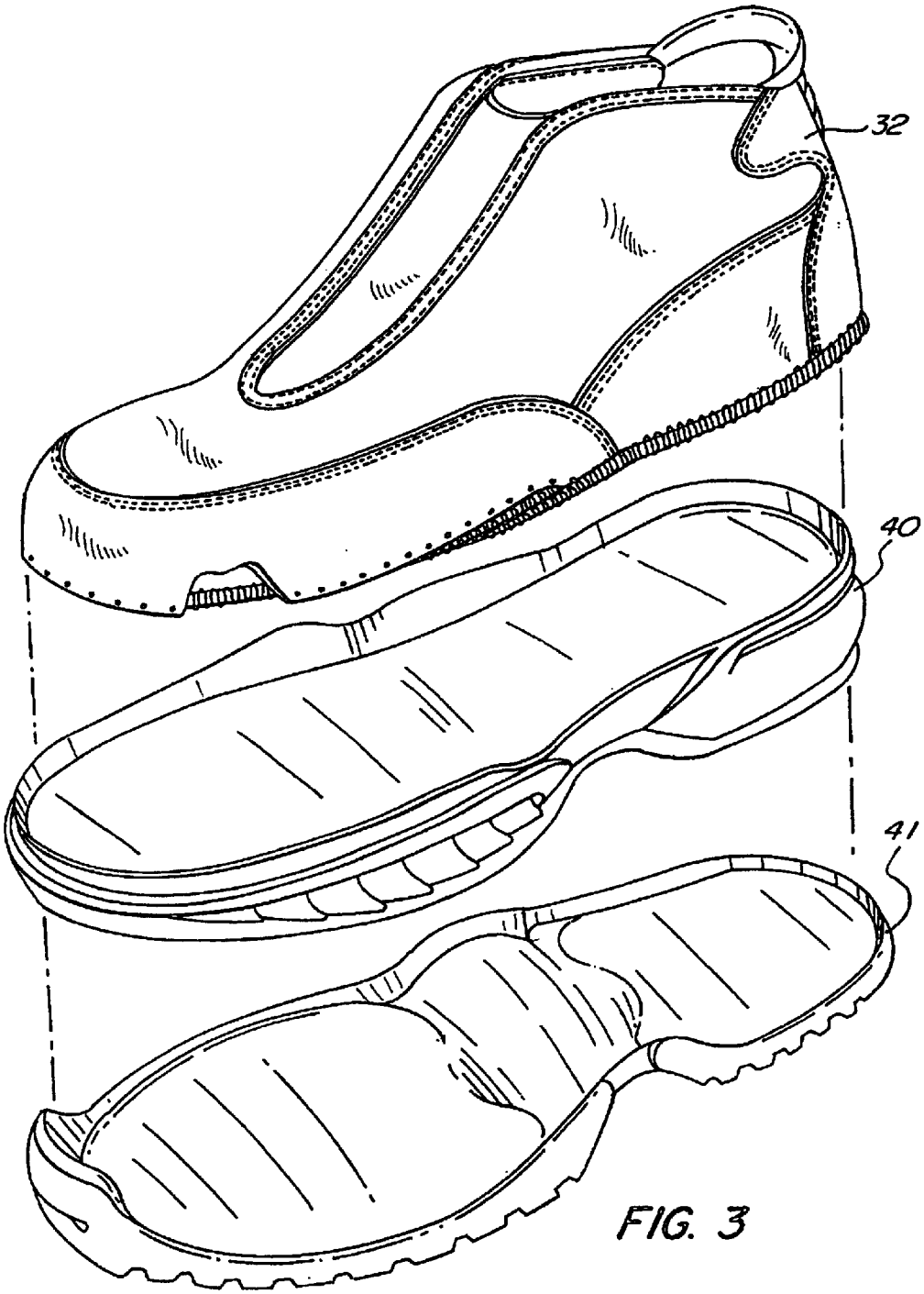
FIG. 3 depicts the relation of the components of the shoe shown in FIG. 2.

As shown in FIG. 3, sole 40 is a midsole, which is later attached to an outsole 41. However, sole 40 need not be limited to being a midsole because, in other embodiments, shoe 30 does not have a midsole and lip 38 is directly connected to the outsole.

Figure 10:
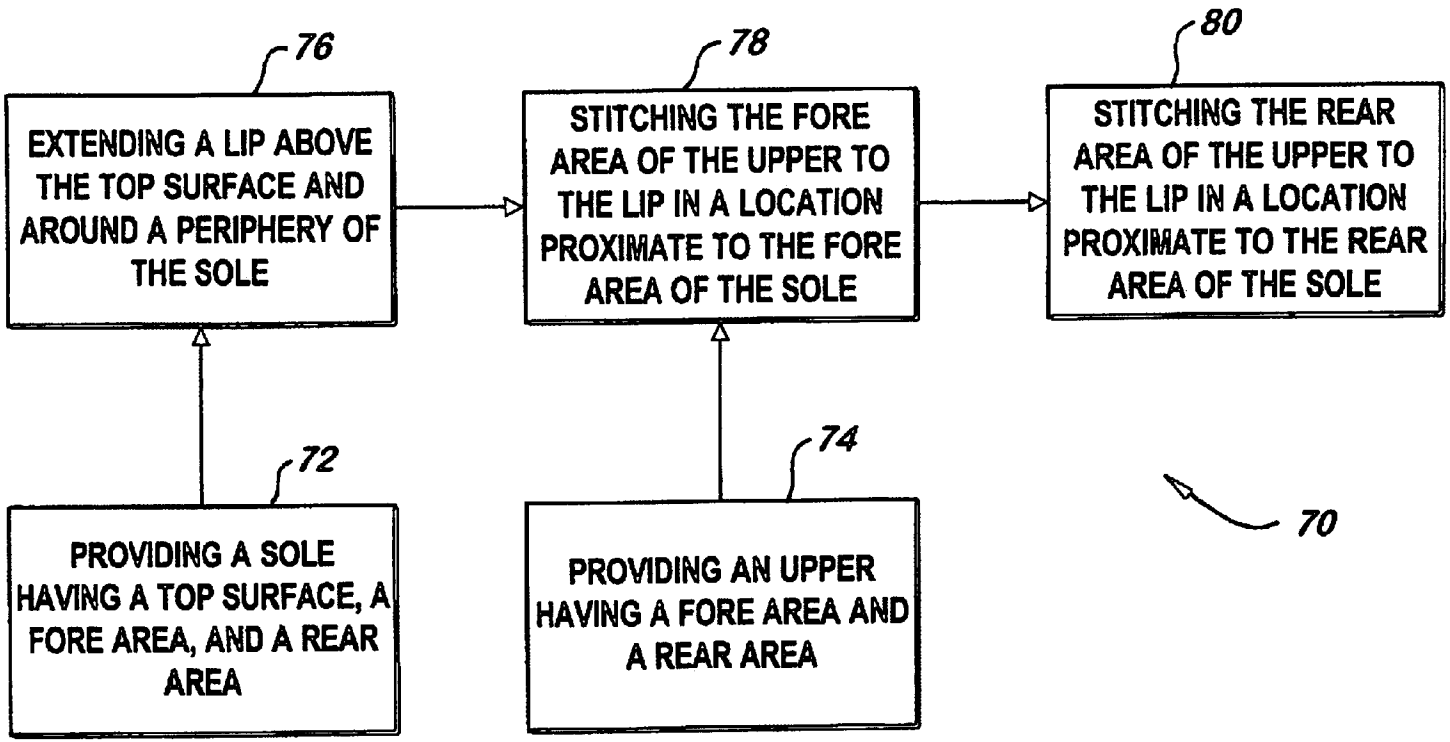
FIG. 10 depicts the method for constructing the shoe shown in FIGS. 2–9.

FIG. 10 depicts method 70 for constructing the shoe in accordance with the invention shown in FIGS. 2–9. Method 70 includes the steps of providing 72 a sole having a top surface, a fore area, and a rear area and extending 76 a lip above the top surface and around a periphery of the fore area of the sole and around a periphery of the rear area of the sole. Method 70 also includes the steps of providing 74 an upper having a fore area and a rear area, stitching 78 the fore area of the upper to the lip in a location proximate to the fore area of the sole, and stitching 80 the rear area of the upper to the lip in a location proximate to the rear area of the sole.

Method 70 stitches 78, 80 the fore and rear areas of the upper to the lip proximate to the fore and rear areas of the sole without providing a welt or insole as a part of the shoe or without using cement in the fore or rear areas of the sole.

Figure 11:
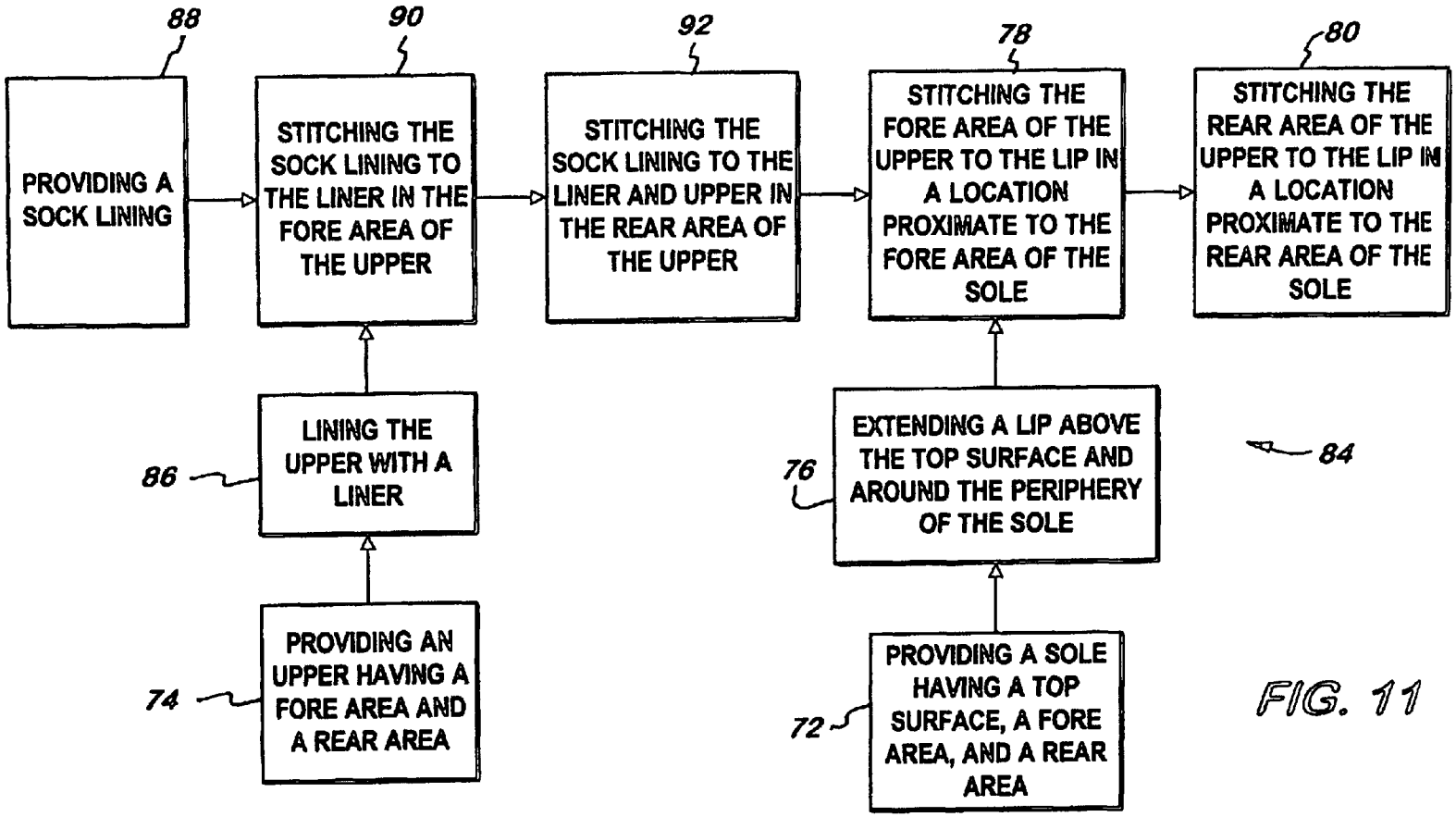
FIG. 11 depicts another aspect of the method for constructing the shoe shown in FIGS. 2–9.

FIG. 11 depicts another method 84 for constructing the shoe in accordance with the invention. Method 84 includes providing 74 an upper having a fore area and a rear area, as described above, lining 86 the upper with a liner, and providing 88 a sock lining. Method 84 also includes stitching 90 the sock lining to the liner in the fore area of the upper and stitching 92 the sock lining to the liner and upper in the rear area of the upper.

Figure 12:
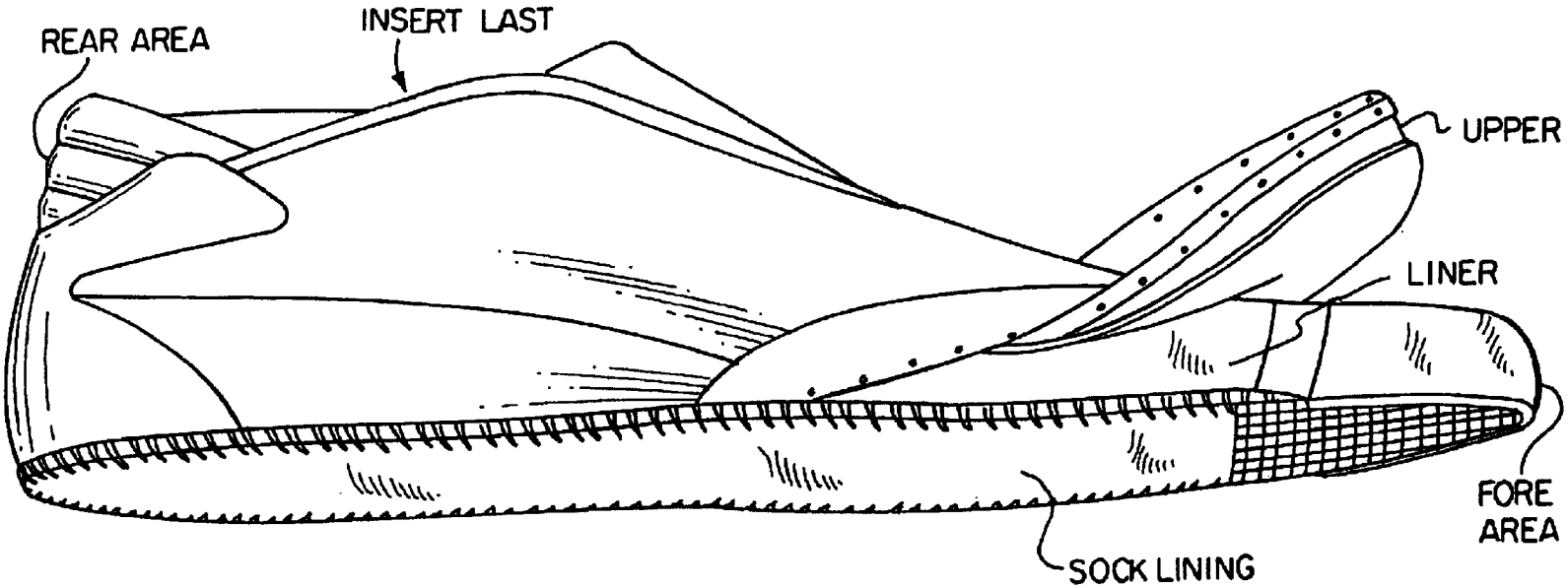
FIG. 12 depicts the upper, lining, and sock lining used in the method shown in FIG. 11.

The step of stitching 90 the sock lining to the liner in the fore area of the upper but not to the upper itself leaves the upper, in the fore area, free and unsecured, as shown in FIG. 12. This step differs from stitching 92 the sock lining to the liner and upper in the rear area of the upper, also as shown in FIG. 12.

As shown in FIG. 12, the sock lining provides a bottom to the upper by being sewn to the liner and/or upper, thereby providing a cavity for receiving a last, which is a structure inserted into the shoe, like a foot, for providing shape to the upper. Once the last is inserted, the fore part of the upper is sewn to the lip of the sole.

Figure 8:
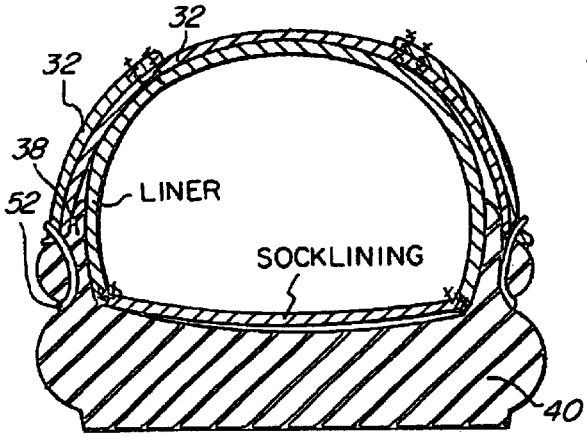
FIG. 8 depicts a cross sectional view of the fore area of the shoe shown in FIG. 2.

As shown in FIG. 8, which is a cross sectional view of fore area 44, one can see that lip 38 is between the liner and upper 32. This permits the unsecured upper 32 (resulting from stitching 90 the sock lining to the liner in the fore area of the upper but not to the upper itself) to be Opanka stitched to lip 38 in fore area 44, as described above.

As shown in FIG. 9, upper 32, the liner, and lip 38 are machine stitched together without a need to leave upper 32 unsecured as in fore area 44.

Method 84 further provides 72 a sole with a top surface, fore area, and rear area and extends 76 a lip above the top surface and around a periphery of the fore area of the sole and around a periphery of the rear area of the sole, both of which were previously described above.

Method 84 further includes the steps of stitching 78 the fore area of the upper to the lip in a location proximate to the fore area of the sole and stitching 80 the rear area of the upper to the lip in a location proximate to the rear area of the sole, both of which were previously described above.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A shoe, comprising:

a sole having a top surface, a fore area, and a rear area;

a lip extending above said top surface and around a periphery of said fore area of said sole and around a periphery of said rear area of said sole;

an upper having a fore area and a rear area and being in contact with said lip;

a first stitch connecting said fore area of said upper to said lip proximate to said fore area of said sole;

a second stitch connecting said rear area of said upper to said lip proximate to said rear area of said sole; and wherein said first stitch and said second stitch connect said upper to said sole without a welt.

2. A shoe, comprising:

a sole having a top surface, a fore area, and a rear area;

a lip extending above said top surface and around a periphery of said fore area of said sole and around a periphery of said rear area of said sole;

an upper having a fore area and a rear area and being in contact with said lip;

a first stitch having a first pattern;

said first stitch connecting said fore area of said upper to said lip proximate to said fore area of said sole;

a second stitch having a second pattern; and said second stitch connecting said rear area of said upper to said lip proximate to said rear area of said sole;

wherein said first stitch and said second stitch connect said upper to said sole without a welt;

wherein said first stitch and said second stitch connect said upper to said sole without an insole; and wherein said first stitch and said second stitch connect said upper to said sole without cement in said fore area or said rear area of said sole.

3. A method for constructing a shoe, comprising the steps of:

providing a sole having a top surface, a fore area, and a rear area;

extending a lip above the top surface and around a periphery of the fore area of the sole and around a periphery of the rear area of the sole;

providing an upper having a fore area and a rear area;

stitching the fore area of the upper to the lip in a location proximate to the fore area of the sole;

stitching the rear area of the upper to the lip in a location proximate to the rear area of the sole; and stitching the upper to the lip without a welt.

4. A method for constructing a shoe, comprising the steps of:

providing a sock lining;

providing an upper having a fore area and a rear area;

lining an inside of the upper with a liner;

stitching the sock lining to the liner in the fore area of the upper;

stitching the sock lining to the liner and upper in the rear area of the upper;

providing a sole having a top surface, a fore area, and a rear area;

extending a lip above the top surface and around a periphery of the fore area of the sole and around a periphery of the rear area of the sole;

stitching the fore area of the upper to the lip in a location proximate to the fore area of the sole; and stitching the rear area of the upper to the lip in a location proximate to the rear area of the sole.

5. The method according to claim 4, further comprising the step of stitching the upper to the lip without a welt.

6. The method according to claim 4, further comprising the step of stitching the upper to the lip without an insole.

7. The method according to claim 4, further comprising the step of stitching the upper to the lip without cement in the fore or rear areas of the sole.

* * * * *